United States Patent [19]

Mecke et al.

[11] Patent Number: 4,995,741

[45] Date of Patent: Feb. 26, 1991

[54] THERMAL PRINT-TRANSFER RIBBON

[75] Inventors: Norbert Mecke, Hanover; Heinrich Krauter, Neustadt, both of Fed. Rep. of Germany

[73] Assignee: Pelikan Aktiengesellschaft, Hanover, Fed. Rep. of Germany

[21] Appl. No.: 272,599

[22] Filed: Nov. 16, 1988

[30] Foreign Application Priority Data

Nov. 17, 1987 [DE] Fed. Rep. of Germany ..... 3738934

[51] Int. Cl.[5] ..... B41J 2/325

[52] U.S. Cl. ..... 400/120; 400/241; 400/241.1

[58] Field of Search ..... 400/120, 291, 241.1, 400/241.2; 521/155; 428/195, 212, 484, 511, 900, 913, 914; 503/221, 227

[56] References Cited

U.S. PATENT DOCUMENTS

| | | | |
|---|---|---|---|
| 4,052,347 | 10/1977 | Dieterich et al. | 521/155 |
| 4,132,552 | 1/1979 | Van Paesschen et al. | 428/484 X |
| 4,138,508 | 2/1979 | Spatz et al. | 503/221 X |
| 4,296,947 | 10/1981 | Spatz et al. | 503/221 X |
| 4,309,117 | 1/1982 | Chang et al. | 400/241.1 |
| 4,419,024 | 12/1983 | Bowlds et al. | 400/120 |
| 4,504,840 | 3/1985 | Evans et al. | 400/120 X |
| 4,549,824 | 10/1985 | Sachdev et al. | 400/241.1 |
| 4,617,224 | 10/1986 | Hotta et al. | 428/914 X |
| 4,700,208 | 10/1987 | Vanier et al. | 503/227 |
| 4,731,278 | 3/1988 | Ryoke et al. | 428/900 |
| 4,734,397 | 3/1988 | Harrison et al. | 428/914 X |
| 4,783,376 | 11/1988 | Sakaki et al. | 428/511 |
| 4,833,124 | 5/1989 | Lum | 428/913 |

FOREIGN PATENT DOCUMENTS

| | | |
|---|---|---|
| 0152795 | 8/1985 | European Pat. Off. . |
| 0227091 | 1/1987 | European Pat. Off. . |
| 0228065 | 8/1987 | European Pat. Off. . |
| 0260347 | 3/1988 | European Pat. Off. . |
| 59-165690 | 9/1984 | Japan . |
| 60-236788 | 11/1985 | Japan . |
| 63-60794 | 3/1988 | Japan . |

*Primary Examiner*—Edgar S. Burr
*Assistant Examiner*—Joseph R. Keating
*Attorney, Agent, or Firm*—Herbert Dubno

[57] ABSTRACT

The reflectivity and shininess of print applied in a thermal-printing process using a thermocolor or thermocarbon ribbon can be reduced by providing a nonmeltable intermediate organic layer between the thermocolor transfer layer and the carrier which comprises a water-soluble material in the form of an aminoplast, a starch or cellulose derivative or a polymer such as polyvinylpyrrolidone, polyvinylalcohol, polyacrylate or polymethylacrylate.

19 Claims, 1 Drawing Sheet

THERMAL PRINT-TRANSFER RIBBON

CROSS REFERENCE TO RELATION APPLICATIONS

This application is related to the commonly assigned copending applications Ser. No. 07/109,489 filed Oct. 15, 1987 MECKE et al, Ser. No. 07/152,641 filed Feb. 5, 1988 MECKE et al, Ser. No. 07/154,651 filed Feb. 10, 1988 MECKE et al and Ser. No. 07/234,970 filed Aug. 19, 1988 MECKE et al.

Reference may also be had to the patents and other publications and prior applications mentioned therein.

FIELD OF THE INVENTION

Our present invention relates to a thermal-transfer ribbon and particularly a thermocolor ribbon, especially a thermocarbon ribbon, of the type in which a meltable layer containing a coloring substance can be transferred by the action of heat and pressure from a carrier, e.g. a foil, to a substrate by the action of a printer head or the like, to transfer to the substrate a portion of the colored material in the form of a symbol, such as an alphanumeric character, or the like. The color-transfer ribbon can also be referred to as a multiple-color layer or can contain a multiple-color material.

BACKGROUND OF THE INVENTION

Thermocolor ribbons have been known for some time. Generally they comprise a foil-like carrier, for example of paper, a synthetic resin or the like and a multiple-color layer which can be in the form of a synthetic resin and/or wax-bound colorant or carbon-black layer.

In the printing of a symbol upon a substrate, a printing head can apply heat and pressure to the side of the carrier opposite that provided with the transfer layer and the transfer layer thereby moved into contact with the substrate, e.g. a paper sheet adapted to receive the imprint. Under the heat and pressure applied by the printing head, which can have the form of the symbol to be printed or may be a dot matrix head progressively changing the shape of the symbol, the colored material is partly transferred to the paper and fuses thereto.

Thermal printers or printer heads for this purpose are described in German published applications DE-AS No. 2,062,495 and DE-AS No. 2,406,613, as well as in German open application DE-OS No. 3,224,445.

Utilizing such printing heads, alphanumeric characters can be applied to the paper. In these systems, moreover, the heated printing head presses the thermocolor ribbon against the paper to be inscribed. The letters of the printing fonts on the printing head are heated to a temperature of about 400° C. to cause the localized melting color transfer layer to permit the locally melted portion to be transferred to the paper sheet and bonded thereto. The utilized part of the ribbon is wound on a take-up spool.

The thermocolor ribbon can have a plurality of melt colors which can be applied in succession. For example, if three base colors, blue, yellow and red are applied from respective strips of the thermocolor ribbon, a colored imprint can be generated. Utilizing this principle, it is possible to effect color printing without the development or fixing steps required in color photography. The thermal-printing head and printing mechanisms utilized at the present time are capable of operating at high speeds, for example, being capable of printing a full A4 sheet of paper in about 10 seconds, without excessive noise.

Apart from the thermocolor ribbons described, there are thermal-transfer ribbons which effect the transfer of imprints from heated symbols, not from a heated printing head, but rather from a resistance-heated foil-like carrier.

The melt-color layer which is the functional layer in the printing process, nevertheless functions in the same way. These materials are referred to as electrothermal ribbons or ETR ribbons. A corresponding thermal printing system has been described in U.S. Pat. No. 4,309,117.

Mention may also be made of the fact that thermal transfer materials are known in sheet form. Reference may be had in this regard to European patent application No. 0 260 347 published Mar. 23, 1988 and which is actuated by the priority application of the present case, to European patent application publication No. 0 152 795 of Aug. 29, 1985 and U.S. Pat. No. 4,549,824.

In general, it has been found that in the use of thermal transfer or thermocolor ribbons, the transferred symbol, i.e. the print on the substrate or paper sheet, has a shiny, highly reflective and frequently unesthetic appearance which under some circumstances can make the image difficult to perceive or the text difficult to read. The reflectivity or shininess of the transferred material is therefore a drawback which has impeded use of the thermocolor process.

OBJECTS OF THE INVENTION

It is the principal object of the present invention, therefore, to provide an improved method of thermal printing which will overcome this drawback.

Another object of this invention is to provide an improved thermocolor ribbon which can transfer, upon thermal printing, symbols or characters to the substrate whose reflectivity or shininess is markedly reduced.

We have discovered that these objects can be attained by applying between the carrier and thermocolor transfer layer, a further or intermediate layer which does not melt during the thermal printing process and has characteristics such that it will result in a less shiny or reflective transferred character on the substrate. In particular, we have discovered that the organic substance, which should have a stronger adhesion to the carrier than to the melted thermocolor material, should be from a limited class of water-soluble starch or cellulose derivatives, polymers, and melamine-type precondensates.

While generally it has been suggested heretofore to provide intermediate layers between the carrier and the thermal transfer layer (see the aforementioned copending applications, for example, as well as U.S. Pat. No. 4,617,224 and German open application DE-OS No. 36 34 049), the intermediate layers in these systems are of a different character and are intended to improve the multiuse properties of the ribbon or to improve the quality of the print obtained on rough paper substrates.

More specifically, the improved thermocolor ribbon of the present invention comprises:

- a carrier band;
- a transfer layer of a meltable colored material transferable on heating to the substrate and provided on one side of the carrier band; and
- an intermediate layer interposed between the side of the carrier band and the transfer layer and having a stronger adhesion to the carrier band than to the transfer layer, the intermediate layer reducing the shiny appearance of the symbol formed by the meltable colored material on transfer to the substrate and consisting of at least one water-soluble organic substance selected from the group which consists of:

water-soluble starch and cellulose compositions, water-soluble polymers in the form of at least one of the polymers polyvinylpyrrolidone, polyvinylalcohol, polyacrylates and polymethacrylates, and water-soluble aminoplast resins.

The method of the invention may comprise the step of reducing reflectivity of the transferred symbol and shininess thereof by interposing between the transfer layer and the side of the carrier band an intermediate layer having a stronger adhesion to the carrier band than to the transfer layer, the intermediate layer consisting of at least one water-soluble organic substance selected from the group which consists of:

water-soluble starch and cellulose compositions, water-soluble polymers in the form of at least one of the polymers polyvinylpyrrolidone, polyvinylalcohol, polyacrylates and polymethacrylates, and water-soluble aminoplast resins.

As will be apparent, an important feature of the thermocolor ribbon of the invention is that the organic substance which is not melted during the thermal-printing process or meltable at the transfer temperatures which melt the thermocolor layer can be a polymeric substance which, during the thermal-printing process, has a stronger adhesion to the carrier than to the melted color-transfer material.

As a consequence, the intermediate layer of the organic substance, which preferably has a thickness of about 0.05 to 0.5 micrometers, especially 0.1 to 0.3 micrometer, remains adherent to the carrier of the thermocolor ribbon or the thermocarbon ribbon during use.

Surprisingly, the effect desired by the invention is not obtained when the intermediate layer is hydrophobic or lipophilic. There are compounds, of course, which are hydrophilic and also lipophilic, but we have found that it is important from the point of view of the invention that the hydrophilic character dominate since this at least in part insures the greater adhesion to the carrier and the desired effect on the appearance of the transferred material.

The preferred water-soluble starch and cellulose derivatives are methylcellulose, carboxymethylcellulose and hydroxymethylstarch.

The preferred water-soluble polymers are polyvinylpyrrolidone, polyvinylalcohol, polyacrylates and polyvinylacrylates and/or polymethylacrylates. The preferred melamine resins are melamine-formaldehyde precondensates and the latter represent the best example of the intermediate layer substances currently known to us.

These substances are preferably coated onto the carrier of the thermocolor ribbon in aqueous solution or dispersion by conventional coating techniques, for example, utilizing doctor blades or the like. The water serving as the vehicle is evaporated at an elevated temperature, for example 80° to 100° C., and the melt color applied to the intermediate layer by techniques known in the art and from the copending applications mentioned above.

The term "aminoplast resins" as used herein is intended to mean particularly the aminoplast precondensates of which an example is a urea-type formaldehyde precondensate. We use the term "urea-type" to refer to compounds which have a urea structure including, thereby, urea itself, thiourea, melamine, guanidine, N-alkyl urea (where alkyl represents $C_1$–$C_9$ straight-chain or branched-chain modalities).

The aminoplast precondensates which can be specifically named, therefore, are monomethylolurea, dimethylolurea and/or water-soluble low-molecular weight urea-formaldehyde condensation products of monomethylolurea, dimethylolurea, urea or formaldehyde. The best-mode embodiment, as mentioned, can make use of melamineformaldehyde precondensates utilizing polymeric methylolmelamine and polymeric methylolated methylolmelamine of low-molecular weight.

Of course it is also possible to use a monomer of the above starting compounds, especially methylolmelamine, methylated methylmelamine and apply them to the carrier so that at elevated temperature upon evaporation of water, a condensation will occur to generate the desired chemical characteristics of the intermediate layer in situ.

In practice, we have found the following commercially available products to be most advantageous:

partially saponified melamine resin (marketed under the name MADURIT MW 815 by Hoechst AG), methylcellulose (TYLOSE MH 200K from Hoechst AG) and polyvinylpyrrolidone (LUVISKOL K30 from BASF AG).

The effect of reducing the reflectivity of the transferred print and the shininess thereof can be increased in accordance with a feature of the invention by incorporating into the organic substance forming the intermediate layer or the dispersion from which the substance is applied to the carrier, at least one pigment; and in a preparation such that the surface of the intermediate layer contacting the transfer layer, i.e. the interface between the two, is rough. The surface roughening has been found to greatly improve the reflectivity-reducing and shininess-limiting effect on the transferred symbol. The pigment is preferably pulverulent silicon dioxide and may make up 5 to 25% by weight of the intermediate layer or the nonmeltable organic substance thereof.

When the thermocolor ribbon is used to print alphanumeric characters or other symbols on commercial paper, the reflectivity can be greatly reduced in accordance with the present invention as can be determined by physical measurements. It is not, however, completely clear as to why there is this reduction in the shininess. Indeed, it is surprising that an intermediate layer which remains on the carrier and thus is not transferred with the color material to the paper can so reduce the shininess or reflectivity. It appears that the phenomenon is a surface effect which is strictly related to the nature of the intermediate layer since it has not been found that either carrier or the particular melt-color material which is used influences the effect.

Indeed, all conventional carrier materials, including those mentioned in the copending applications and of conventional melt-color materials including those of the copending applications can be utilized with the improvement obtained with the present invention.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 2:
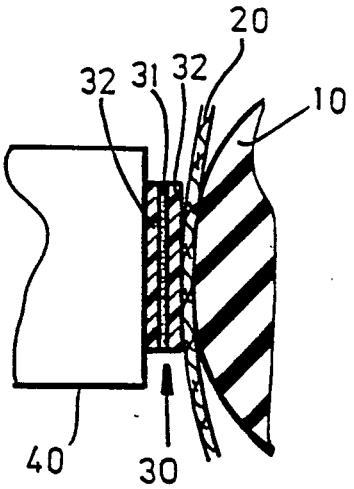
FIG. 2 is a diagrammatic cross-sectional view illustrating the thermocolor ribbon of the invention in conjunction with a substrate.

In FIG. 2 of the drawing, we have shown a platen 10 of a thermal-printing machine along which is guided a paper substrate 20. The substrate 20 is juxtaposed with a thermocolor or thermocarbon ribbon 30, according to the invention so that a thermal-printing head 40 can apply heated font characters, for example, to effect local melting of a color-transfer layer 32 of the ribbon 30 and bonding of the locally-melted material to the substrate 20.

The thermocolor ribbon 30 comprises a carrier 31 and a thermocolor or transfer layer 32 which is provided on the carrier 31 and is positioned to contact the substrate 20. According to the invention, between the thermal-transfer layer 32 and the carrier 31, an intermediate layer 33 which is not meltable at the temperature of the head 40 and in the thermal-printing process, is provided to reduce the reflectivity of the transferred material.

The effect will be better described in the specific examples which follow.

SPECIFIC EXAMPLES

The effect obtained with the invention is measured with a reflectometer utilizing the reflection-measuring principles of German Industrial Standard DIN 67 530. A standard material with a reflectivity value of 100% is provided and the reflectivity or shininess of the print is given in percentage terms utilizing this standard as 100%.

Figure 1:
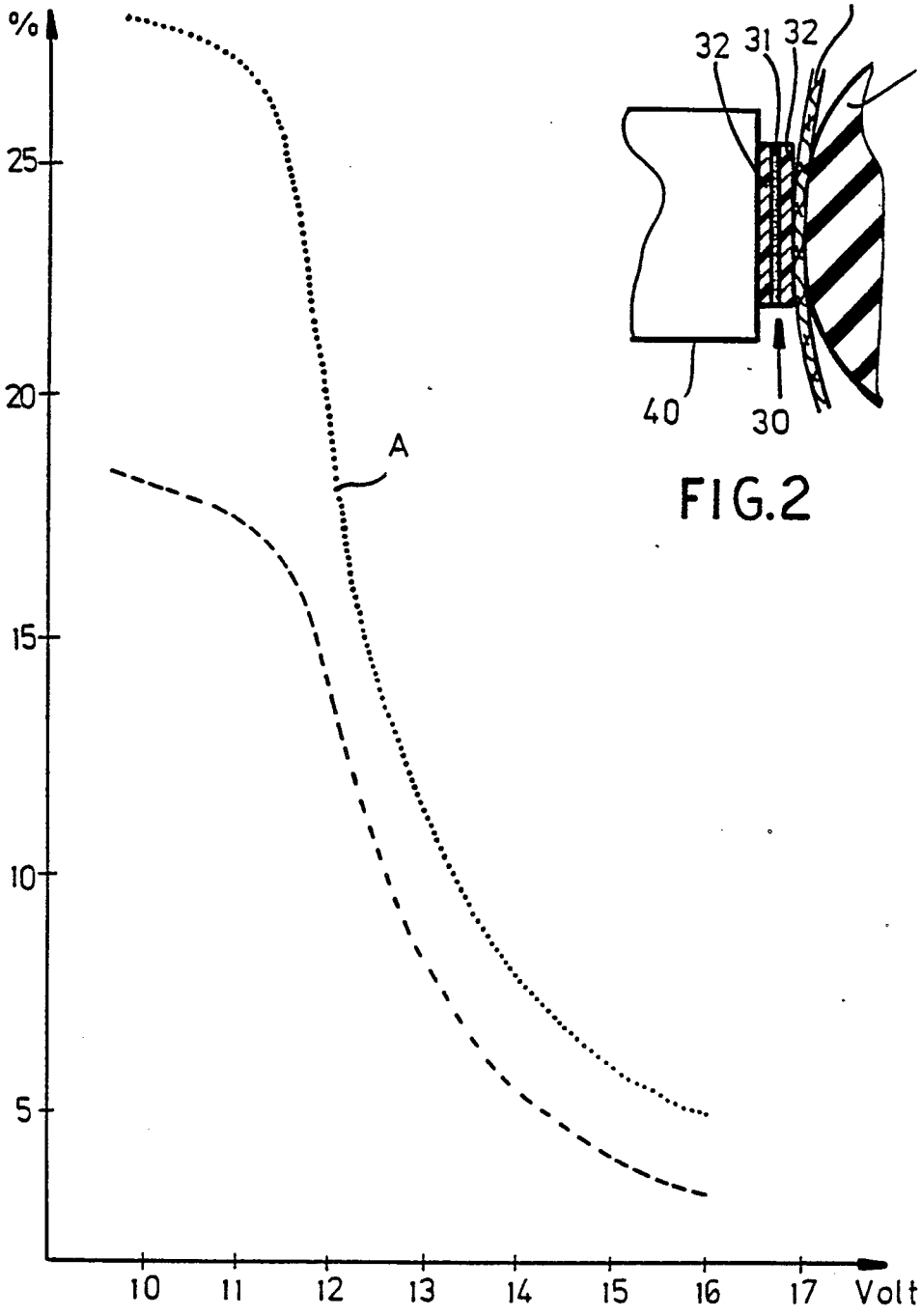
FIG. 1 is a graph illustrating the results discussed in connection with the specific example.

The relative reflectivity, therefore, is plotted along the ordinate in FIG. 1.

Along the abscissa in FIG. 1, we have plotted the voltage which is applied to the thermal-printing head 40 and is thus a measure of the energy delivered by the thermal-printing head 40, i.e. the thermal-printing energy.

A conventional thermocolor ribbon 30 has a characteristic curve as illustrated by the graph A defined by dots. At relatively low energization, the relative reflectivity is about 27%. When the very same ribbon 30 is used except at an intermediate layer 33 in accordance with the invention, however, at the same voltage, the relative reflectivity is only 18% and it is possible in all cases to provide a lower reflectivity than without the intermediate layer 33.

Indeed, the reduction in reflectivity is viewed as a difference between shiny and mat finish.

EXAMPLE I

The thermocolor ribbon 30 has a melt color or transfer layer 32 consisting of 15% by weight ester wax, 50% by weight paraffin, 20% by weight ethylenevinylacetate and 10% by weight carbon black. The carrier 31 is the polyester foil. The intermediate layer 33 has the following composition:

1.4% by weight paraffin saponified melamine resin (MADURIT MW 815, Hoechst AG), 2% by weight of acrylate dispersion (MOWILITH VDM 7830, about 50% from Hoechst AG), 0.2% by weight EROSIL (silicon dioxide pigment), 66.4% by weight water, 30.0% by weight ethylalcohol and 0.03% by weight paratoluene sulphonic acid (for hardening the MADURIT).

This dispersion is applied by a doctor blade onto the carrier 31 and the water is evaporated at 80° C. The intermediate layer 33 thickness was about 0.05 micrometer.

The melt layer 33 was applied to this intermediate layer by conventional melt coating (see the aforementioned applications). Without the intermediate layer, the ribbon showed a reflectivity of about 27% and with the intermediate layer reflectivity of about 18%.

EXAMPLE II

The method in parameters of Example I were used except that the intermediate layer 33 was constituted by evaporating water from a composition consisting of 90% by weight water and 10% by weight methylcellulose (TYLOSE MH 200K from Hoechst AG). Similar results were obtained.

EXAMPLE III

Similar results were also obtained when the system of Example I was used but the intermediate layer 33 was formed from a mixture of 90% by weight water and 10% by weight polyvinylpyrrolidone (LUVISKOL K30 from BASF AG).

We claim:

1. A thermal transfer ribbon for use in a thermal transfer process, comprising:

a carrier band;

a transfer layer on one side of said band and composed of a material melting during said process for transfer to a substrate; and means for reducing relative reflectivity of said transferred melted material to no higher than about 18% per DIN 67 530, said means including an intermediate layer, said intermediate layer disposed between said transfer layer and said band and being composed of a hydrophilic organic substance which is nonmeltable during said process and has a greater adhesion to said carrier band than to said transfer layer.

2. The thermal ribbon defined in claim 1 wherein said intermediate layer has a thickness of about 0.005 to 0.5 micrometer.

3. The thermal ribbon defined in claim 1 wherein said organic substance is a water-soluble starch or cellulose derivative.

4. The thermal ribbon defined in claim 3 wherein said water-soluble starch or cellulose derivative is selected from the group which consists of methylcellulose, carboxymethylcellulose, hydroxymethylstarch and mixtures thereof.

5. The thermal ribbon defined in claim 1 wherein said organic substance is a water-soluble polymer selected from the group which consists of polyvinylpyrrolidone, polyvinylalcohol, polyacrylates, polymethacrylates, and mixtures thereof.

6. The thermal ribbon defined in claim 1 wherein said organic substance is a water-soluble melamine resin.

7. The thermal ribbon defined in claim 6 wherein said water-soluble melamine resin is a melamine-formaldehyde precondensate.

8. The thermal ribbon defined in claim 1, further comprising a pigment incorporated in said intermediate layer to roughen a surface thereof.

9. A thermal transfer ribbon for the transfer of a symbol to a substrate upon application of a printing member to the ribbon and heating of the ribbon, said thermal transfer ribbon comprising:

a carrier band;

a transfer layer of a meltable colored material transferable on heating to said substrate and provided on one side of said carrier band; and means for reducing relative reflectivity of said transferred melted layer to no higher than about 18% per DIN 67 530, said means including a hydrophilic intermediate layer interposed between said side of said carrier band and said transfer layer and having a stronger adhesion to said carrier band than to said transfer layer, said intermediate layer reducing the shiny appearance of the symbol formed by the meltable colored material on transfer to said substrate and consisting essentially of at least one water-soluble organic substance selected from the group which consists of:

water-soluble starch and cellulose compositions, water-soluble polymers in the form of at least one of the polymers polyvinylpyrrolidone, polyvinylalcohol, polyacrylates and polymethacrylates, and water-soluble aminoplast resins.

10. The thermal transfer ribbon defined in claim 9 wherein said water-soluble organic substance is a water-soluble starch and cellulose composition selected from the group which consists of methylcellulose, carboxymethycellulose, hydroxymethylstarch and mixtures thereof.

11. The thermal transfer ribbon defined in claim 9 wherein said water-soluble organic substance is a water-soluble melamine-formaldehyde precondensate.

12. The thermal transfer ribbon defined in claim 9 wherein said intermediate layer has a thickness of substantially 0.05 to 0.5 micrometer.

13. The thermal transfer ribbon defined in claim 12 wherein said intermediate layer has a thickness of substantially 0.1 to 0.3 micrometer.

14. The thermal transfer ribbon defined in claim 13 wherein said water-soluble substance includes at least one pigment in an amount sufficient to form a roughened surface of said intermediate layer in contact with said transfer layer, said pigment constituting substantially 5 to 25% by weight of said intermediate layer.

15. The thermal transfer ribbon defined in claim 14 wherein said pigment is pulverulent silicon dioxide.

16. In a method of transferring a symbol to a substrate by application of a printing member to a thermal transfer ribbon and heating of the ribbon, said thermal transfer ribbon comprising a carrier band and a transfer layer of a meltable colored material transferable on heating to said substrate and provided on one side of said carrier band, the improvement which comprises the step of reducing reflectivity of the transferred symbol and shininess thereof by interposing between said transfer layer and said side of said carrier band a means for reducing relative reflectivity of said transferred melted material to no higher than about 18% per DIN 67 530, said means including a hydrophilic intermediate layer having a stronger adhesion to said carrier band than to said transfer layer, said intermediate layer consisting essentially of at least one water-soluble organic substance selected from the group which consists of:

water-soluble starch and cellulose compositions, water-soluble polymers in the form of at least one of the polymers polyvinylpyrrolidone, polyvinylalcohol, polyacrylates and polymethacrylates, and water-soluble aminoplast resins.

17. The method defined in claim 16, further comprising the step of incorporating in said intermediate layer 5 to 25% by weight of a pigment imparting a roughened surface to said intermediate layer in contact with said transfer layer.

18. The method defined in claim 17 wherein said water-soluble organic substance is a water-soluble starch and cellulose composition selected from the group which consists of methylcellulose, carboxymethylcellulose, hydroxymethylstarch and mixtures thereof, said intermediate layer having a thickness of substantially 0.05 to 0.5 micrometer.

19. The method defined in claim 17 wherein said water-soluble organic substance is a water-soluble melamine-formaldehyde precondensate, said intermediate layer having a thickness of substantially 0.05 to 0.5 micrometer.

* * * * *